US007785122B2

(12) United States Patent
Pallino et al.

(10) Patent No.: US 7,785,122 B2
(45) Date of Patent: Aug. 31, 2010

(54) CLIP CORD POWER CONNECTOR

(75) Inventors: Jonathan M. Pallino, 10025 Oasis Palm Dr., Tampa, FL (US) 33615; Kevin Hurt, Tampa, FL (US)

(73) Assignee: Jonathan M. Pallino, Tampa, FL (US)

( * ) Notice: Subject to any disclaimer, the term of this patent is extended or adjusted under 35 U.S.C. 154(b) by 0 days.

(21) Appl. No.: 12/308,685

(22) PCT Filed: Jun. 7, 2007

(86) PCT No.: PCT/US2007/013379

§ 371 (c)(1),
(2), (4) Date: Dec. 22, 2008

(87) PCT Pub. No.: WO2008/002383

PCT Pub. Date: Jan. 3, 2008

(65) Prior Publication Data

US 2009/0280667 A1 Nov. 12, 2009

(51) Int. Cl.
*H01R 11/22* (2006.01)

(52) U.S. Cl. ..... 439/269.1

(58) Field of Classification Search ..... 439/269.1, 439/269.2, 822, 829, 835
See application file for complete search history.

(56) References Cited

U.S. PATENT DOCUMENTS 1,559,250 A * 10/1925 Hampton ..... 439/269.1
1,890,484 A * 12/1932 Allenic ..... 439/269.2
2,704,837 A * 3/1955 Wintriss ..... 439/825
2,719,956 A * 10/1955 Leighton ..... 439/278
3,169,816 A * 2/1965 Hammond et al. ..... 439/269.1
3,624,590 A * 11/1971 Bolduc ..... 439/269.1
3,644,877 A * 2/1972 Carbonneau ..... 439/729
3,850,493 A * 11/1974 Clewes et al. ..... 439/269.1
3,937,546 A * 2/1976 Clewes et al. ..... 439/269.1
4,029,381 A * 6/1977 Tarrall et al. ..... 439/269.1
4,030,796 A * 6/1977 Patzer ..... 439/269.1
4,090,760 A * 5/1978 Furey ..... 439/269.1
4,159,659 A 7/1979 Nightingale
4,200,348 A * 4/1980 Stupay ..... 439/269.1
4,206,960 A * 6/1980 Tantillo et al. ..... 439/593
4,268,101 A * 5/1981 Stone ..... 439/86
4,674,817 A * 6/1987 Olms ..... 439/592
4,749,362 A * 6/1988 Hoffman et al. ..... 439/269.1
5,054,339 A 10/1991 Yacowitz
5,139,438 A 8/1992 Gaffney et al.
6,282,987 B1 9/2001 Moniz
6,550,356 B1 4/2003 Underwood
6,596,007 B2 7/2003 Evans
6,716,040 B1 * 4/2004 Martin et al. ..... 439/95
6,772,656 B2 8/2004 Godoy
6,774,754 B2 8/2004 Evans
2005/0090851 A1 4/2005 Devlin
2008/0089067 A1 * 4/2008 Grosjean ..... 362/285

* cited by examiner

*Primary Examiner*—T C Patel
*Assistant Examiner*—Vladimir Imas
(74) *Attorney, Agent, or Firm*—Richard C. Litman

(57) ABSTRACT

The clip cord power connector has a U-shaped body (12) with a prong or L-shaped clip (16) attached to each end. A lug extends from each prong (16). A two-conductor power cable (32) is attached to the lugs so that a separate conductor attaches to each of the lugs. The power cable (32) is designed to attach to the power supply for a tattoo machine (30).

13 Claims, 3 Drawing Sheets

CLIP CORD POWER CONNECTOR

TECHNICAL FIELD

The present invention relates to electrical connectors and electrical power supply cables, and more specifically to a clip cord power connector for a power supply cable of a type commonly known in the art as a "clip cord," which is used to connect a power supply to a tattoo machine.

BACKGROUND ART

Tattooing is an ancient art, which has been experiencing renewed popularity in recent years. Professional tattoo artists use a tattoo machine whose basic design has remained essentially unchanged for decades. A tattoo machine generally includes a needle tube that receives a needle, which is locked to a frame at a needle retainer. A needle reciprocates within the needle tube, the assembly being powered by armature coils that impart vibratory motion to an armature bar attached to the upper end of the needle. The vibratory motion of the armature bar causes the needle to reciprocate. Tattoo machines generally operate on direct current at voltages between 4V-15V and currents between 250-1000 ma. The necessary voltage may be supplied by a simple step-down wall transformer, or by a regulated power supply, which may either be a constant voltage supply or a variable voltage supply, and may have a foot-operated switch. A power supply cable is used to connect the power supply to the tattoo machine. The tattoo machine has a pair of widely separated contacts, one connected to the armature coils and the other to ground.

The cable connecting the machine is a two-conductor cable. The two wires are insulated from each other, but contained in a common jacket or with their insulating jackets joined together. At the machine end of the cable, the two conductors are separated into a Y-shape and connected to probe bodies that terminate in L-shaped clips. A helical spring is concentrically disposed around the conductors at the Y-junction with the ends of the spring bearing against the ends of the probe bodies. The spring supplies sufficient resilient bias to keep the L-shaped clips in electrical contact with the armature and ground contacts of the tattoo machine.

While this arrangement works, nevertheless, the connector at the machine end of the power supply cable is a little bulky and causes drag on the cord. The spring and L-shaped clips tend to become worn or to break with extensive use. Consequently, there is a need for a better connector for a power supply cable for attaching a power supply to a tattoo machine.

Thus, a clip cord power connector solving the aforementioned problems is desired.

DISCLOSURE OF INVENTION

The disclosure is directed to a clip cord power connector. The power connector includes an elongated substantially U-shaped body that is formed from an electrically nonconductive, flexible material. The opposing ends of the body are compressible towards each other and resiliently biased to regain the U-shape when a force compressing the U-shape is removed. The power connector also includes electrically conductive contacts that extend from each of the opposing ends of the U-shaped body. Each of the contacts has an L-shaped prong. A lug is electrically connected to each of the contacts. The lugs and the contacts at the opposing ends of the U-shaped body are electrically separated from each other by the electrically nonconductive U-shaped body. The lugs are adapted for attachment to a two-conductor power cable so that each of the conductors is connected to a separate one of the lugs. In operation, the opposing ends of the U-shaped body are compressible in order to hook the contacts to a device to be powered. The resilience of the U-shaped body maintains the contacts in electrical connection with the device.

The disclosure is also directed to a two conductor power supply cable. The two conductors are insulated from each other. The first end of the power supply cable is adapted for connection to a power supply. The two conductors are separated at the second end of the power supply cable to form a Y-shape. A clip cord power connector is attached to the second end of the two-conductor power cable. The clip cord power connector has an arcuate, elongated body with opposing ends. The arcuate body of the clip cord power connector body is formed from an electrically nonconductive, flexible material. The opposing ends of the arcuate clip cord power connector body are compressible towards each other, but the body is resiliently biased so that it regains its uncompressed arcuate shape when the force compressing the ends of the body is removed. An electrically conductive contact extends from each of the opposing ends of the arcuate clip cord power connector body. Each of the contacts has an L-shaped prong. A lug is electrically connected to each of the contacts. The lugs and the contacts at the opposing ends of the arcuate clip cord power connector body are electrically separated from each other by the electrically nonconductive arcuate body.

The lugs are attached to the two-conductor power cable so that each of the conductors is connected to a separate one of the lugs. The arcuate body is convex towards the separation forming the Y-shape. In operation, the opposing ends of the arcuate body are compressible in order to hook the contacts to a device to be powered. The resilience of the arcuate body maintains the contacts in electrical connection with the device.

BRIEF DESCRIPTION OF THE DRAWINGS

Similar reference characters denote corresponding features consistently throughout the attached drawings.

BEST MODES FOR CARRYING OUT THE INVENTION

The clip cord power connector of the current invention has a generally U-shaped body with a prong or L-shaped clip attached to each end. A lug extends from each prong. A two-conductor power cable has its conductors divided, with the conductors being attached to separate lugs. The opposite end of the cable has a plug or jack adapted for connection to a power supply for a tattoo machine. The U-shaped body is made from an electrically non-conductive, thermoplastic material, preferably polyester, having sufficient rigidity to normally maintain the U-shape, but sufficient flexibility and resilience to allow the body to be flexed to attach the prongs to the contacts of the tattoo machine. Spring bias keeps the prongs connected to the tattoo machine contacts, the U-shaped body acting as a leaf spring. The lugs and prongs may be attached to the U-shaped body by rivets, and the electrical connections covered by heat shrink tubing.

Figure 1A:
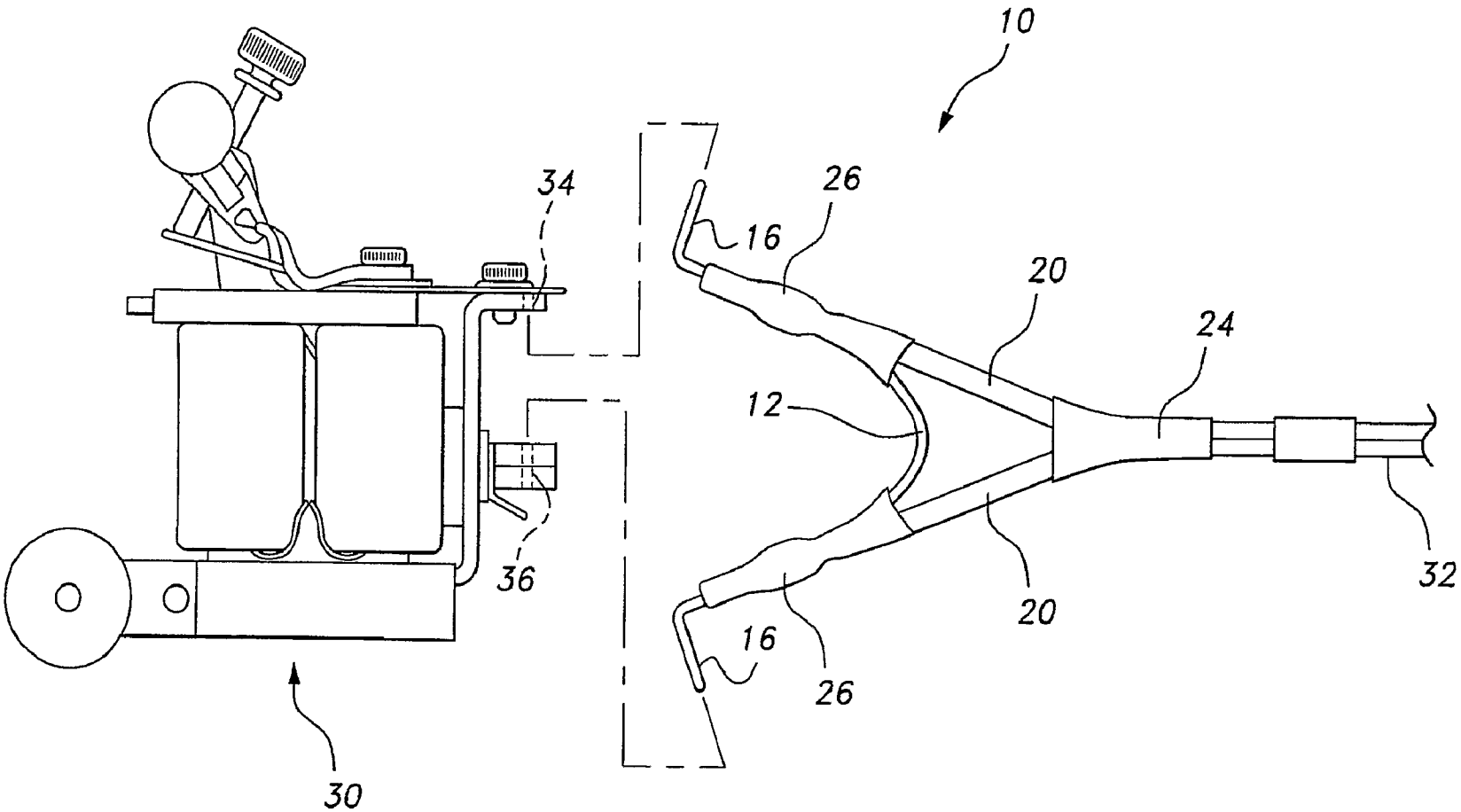
FIG. 1A is an environmental side view of a clip cord power connector according to the present invention, shown detached from a tattoo machine.
Figure 1B:
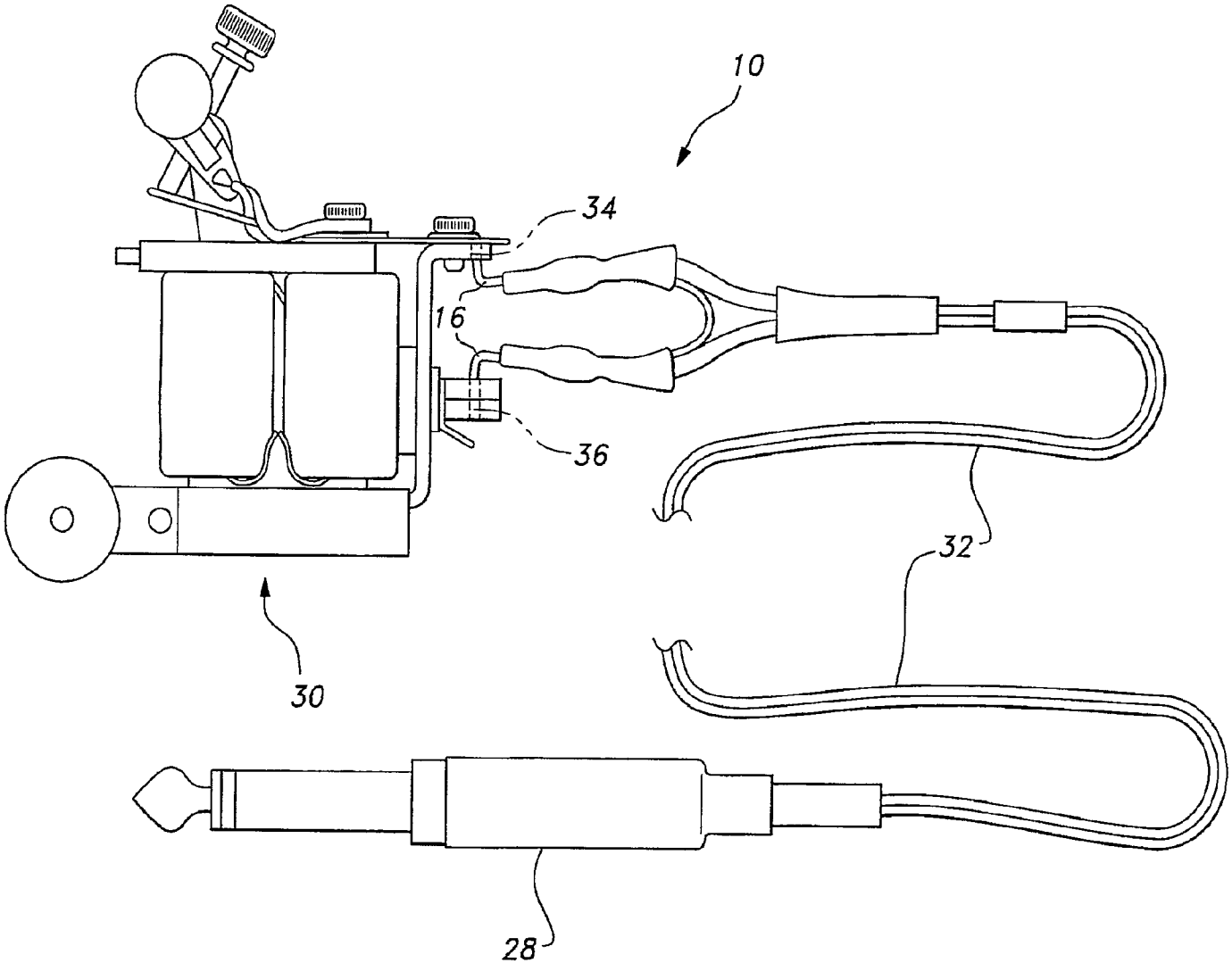
FIG. 1B is an environmental side view of the clip cord power connector and power supply cable according to the present invention, shown connected to the tattoo machine.
Figure 2:
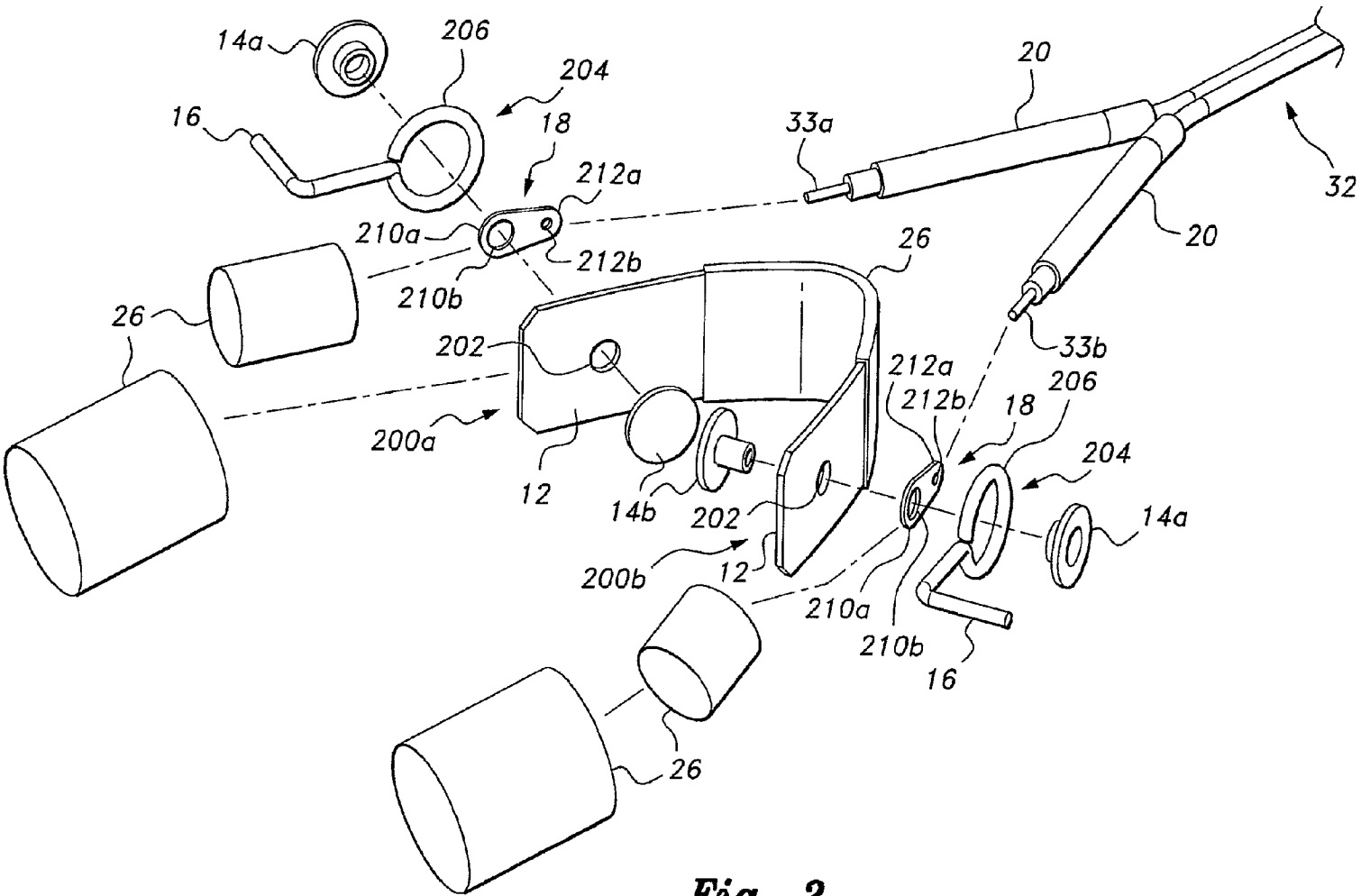
FIG. 2 is an exploded, perspective view of the clip cord power connector according to the present invention.

As shown in FIGS. 1A, 1B and 2, the present invention relates to a clip cord power connector, designated generally as 10 in the drawings, and to a power supply cable 32 incorporating the connector 10, which is used to connect a power supply to a tattoo machine.

The clip cord power connector 10 has a U-shaped body formed from an elongate strip 12 made from a material having sufficient flexibility, resilience, and shape memory that opposing ends 200*a* and 200*b* of the strip 12 can be compressed towards each other to attach right angle prongs or clips 16 to a tattoo machine 30, but will exert outward pressure to regain the original relaxed shape of the strip 12 when the compressive force is removed, thereby providing a spring bias similar to a leaf spring to keep the clips 16 attached to the tattoo machine 30. The elongate strip 12 is preferably made from a flat strip of electrically nonconductive thermoplastic material, such as polyester, that can be heated and formed into a U shape, which is retained after the strip has cooled. The elongate resilient strip 12 may have other acceptable shapes, such as a C-shape or V-shape. Elongated resilient strip 12 may be formed from any other flexible, nonconducting material capable of retaining a preformed shape, including, but not limited to, other plastics, fiberglass, carbon fiber, etc.

Holes 202 are formed in the strip 12 near ends 200*a* and 200*b* in order to provide attachment points for contact members 204. Each contact member 204 is electrically conductive and may be comprised of an annular attachment ring 206 and an L shaped prong contact or clip 16 extending therefrom. Solder lugs 18, each of which has a wide arcuate end 210*a* having a wide diameter hole 210*b* alignable with ring 206, and a narrow arcuate end 212*a* having a narrow diameter hole 212*b* provided to attach current carrying conductors 33*a* and 33*b* to lugs 18 by soldering, thereby electrically connecting conductors 33*a* and 33*b* with the contact members 204. The contact members 204 and lugs 18 are attached to strip 12 by rivets, threaded fasteners or the like, glue, or molded fasteners extending through aligned holes 202, 210*b*, and rings 206.

As shown in FIG. 2, a rivet cap 14*a* is disposed through the annular attachment ring 206 and then through the wide diameter through hole 210*b* of lug 18 to form a contact assembly. The contact assembly is disposed on the outer surface of the strip 12, with a protruding portion of rivet cap 14*a* being disposed through attachment hole 202. The contact assembly is fastened in place on the strip 12 with the attachment of rivet post 14*b* to rivet cap 14*a*. Each conductor wire 33*a* and 33*b* is connected, preferably soldered, to a respective lug 18 at small diameter hole 212*b*. Alternatively, conductor wires 33*a* and 33*b* may be crimped, plugged into, or taped onto lugs 18. To provide insulation, electrically non-conductive heat shrink tubing 20, 24, 26 may enclose selected portions of the clip cord power connector assembly 10. Alternative means of insulation, such as a flexible plastic, neoprene, or other nonconducting shell, may be used to enclose the selected portions of the clip cord power connector assembly 10.

As shown in FIGS. 1A-1B, the clip cord power connector 10 is capable of connecting a tattoo machine 30 to a power supply via cable 32 and plug 28. While FIG. 1B shows a quarter-inch phono plug, power plug 28 may be of any type of connector that is compatible with the power supply being used, such as RCA jacks, 2.1-3.5 mm plugs, banana jacks, pin connectors, Anderson power poles, or even bare wire for attachment to binding posts. Power connection to the tattoo machine 30 is accomplished by a contact 16 being inserted into a hole on the tattoo machine frame 34. The remaining contact 16 is inserted into an isolated ground standoff 36. The resilient strip 12 acts as an insulator and spring to secure the electrical connection to frame 34 and standoff 36. The cable 32 may be any suitable two-conductor cable, such as zip cord, with the two conductors being separated into a Y-shape at the junction with the clip cord power connector 10. It will be understood that cable 32 may be formed from any other two-conductor cable having sufficient current-carrying capacity.

Although the cable 32 and the connector 10 have been described for use with a tattoo machine 30, the cable 32 may be used with any other device having contacts capable of receiving clips 16.

It is to be understood that the present invention is not limited to the embodiments described above, but encompasses any and all embodiments within the scope of the following claims.

The invention claimed is:

1. A clip cord power connector, comprising:

an elongated, substantially U-shaped body having opposing ends, the body being formed from an electrically nonconductive, flexible material, the opposing ends being compressible towards each other and resiliently biased to regain the U-shape when a force compressing the U-shape is removed, the U-shaped body having an inner surface and a substantially continuous outer surface;

an electrically conductive contact extending along the outer surface of the U-shaped body and extending from each of the opposing ends of the U-shaped body, each of the contacts terminating in an exposed L-shaped prong;

a lug electrically connected to each of the contacts, the lugs and the contacts at the opposing ends being electrically separated from each other by the electrically nonconductive body, the lugs being adapted for attachment to a two-conductor power cable, each of the conductors being connected to a separate one of the lugs; and a heat shrink tubing disposed over the opposing ends of the U-shaped body, thereby encasing the connection of the contacts to the U-shaped body, whereby the opposing ends of the U-shaped body are compressible in order to hook the L-shaped contacts to a device to be powered, the resilience of the U-shaped body maintaining the contacts in electrical connection with the device.

2. The clip cord power connector according to claim 1, wherein the U-shaped body is made from a thermoplastic material.

3. The clip cord power connector according to claim 2, wherein the thermoplastic material comprises polyester.

4. The clip cord power connector according to claim 1, further comprising a pair of rivets, the rivets attaching said contacts and said lugs to the opposing ends of said U-shaped body.

5. The clip cord power connector according to claim 1, wherein each of said electrically conductive contacts is elongated and further comprises a ring at the end opposite said L-shaped prong.

6. A power supply cable, comprising:

a two-conductor power cable having a first end adapted for connection to a power supply and a second end, the two conductors being insulated from each other and separated to form a Y-shape adjacent the second end;

a clip cord power connector attached to the second end of the two-conductor power cable, the connector having:

an arcuate, elongated body having opposing ends, the body being formed from an electrically nonconductive, flexible material, the opposing ends being compressible towards each other and resiliency biased to regain the uncompressed arcuate shape when a force compressing the ends is removed, the arcuate body having an inner surface and a substantially continuous outer surface;

an electrically conductive contact extending along the outer surface of the arcuate body and extending from each of the opposing ends of the arcuate body, each of the contacts terminating in an exposed L-shaped prong;

a lug electrically connected to each of the contacts, the lugs and the contacts at the opposing ends being electrically separated from each other by the electrically nonconductive body, the lugs being attached to the two-conductor power cable, each of the conductors being connected to a separate one of the lugs, the arcuate body being convex towards the separation forming the Y-shape; and a heat shrink tubing disposed over the opposing ends of the arcuate body, thereby encasing the connection of the contacts to the arcuate body, whereby the opposing ends of the arcuate body are compressible in order to hook the contacts to a device to be powered, the resilience of the arcuate body maintaining the contacts in electrical connection with the device.

7. The power supply cable according to claim 6, wherein said arcuate body is substantially U-shaped.

8. The power supply cable according to claim 6, wherein the arcuate body is made from a thermoplastic material.

9. The power supply cable according to claim 8, wherein the thermoplastic material comprises polyester.

10. The power supply cable according to claim 6, further comprising a pair of rivets, the rivets attaching said contacts and said lugs to the opposing ends of said arcuate body.

11. The power supply cable according to claim 6, wherein each of said electrically conductive contacts is elongated and further comprises a ring at the end opposite said L-shaped prong.

12. The power supply cable according to claim 6, further comprising a phono plug connected to the first end of said two-conductor power cable.

13. The power supply cable according to claim 6, wherein said two-conductor power cable comprises zip cord.

* * * * *